United States Patent [19]

Johnson et al.

[11] 4,014,386

[45] Mar. 29, 1977

[54] SUBSURFACE SAFETY VALVE APPARATUS

[75] Inventors: Joseph L. Johnson, Houston; Shelby L. Guidry, Conroe, both of Tex.

[73] Assignee: Schlumberger Technology Corporation, New York, N.Y.

[22] Filed: Apr. 23, 1976

[21] Appl. No.: 679,619

[52] U.S. Cl. ..... 166/321; 137/155; 251/57

[51] Int. Cl.[2] ..... E21B 43/12

[58] Field of Search ..... 166/72, 224 A; 137/155; 251/57

[56] References Cited

UNITED STATES PATENTS

| | | | |
|---|---|---|---|
| 3,183,921 | 5/1965 | Garrett | 251/57 |
| 3,802,504 | 4/1974 | Garrett | 166/224 A |
| 3,827,501 | 8/1974 | Johnson et al. | 166/224 A |
| 3,884,300 | 5/1975 | Garrett | 166/224 A |

*Primary Examiner*—James A. Leppink
*Attorney, Agent, or Firm*—David L. Moseley; William R. Sherman; Stewart F. Moore

[57] ABSTRACT

In accordance with an illustrative embodiment of the present invention, a subsurface safety valve assembly includes a dome precharged with a set reference pressure that tends to close the valve, and means responsive to both ambient pressure and to the pressure of a control fluid for holding the valve open under normal conditions, a decrease in either control fluid pressure or tubing pressure, or both, enabling the dome pressure to cause the valve to automatically close and shut-in the well. The valve does not employ a coil spring to cause closure, which permits installation at great depths in a well, and a narrow spread between valve opening and closing pressures.

17 Claims, 5 Drawing Figures

Figure 2B:
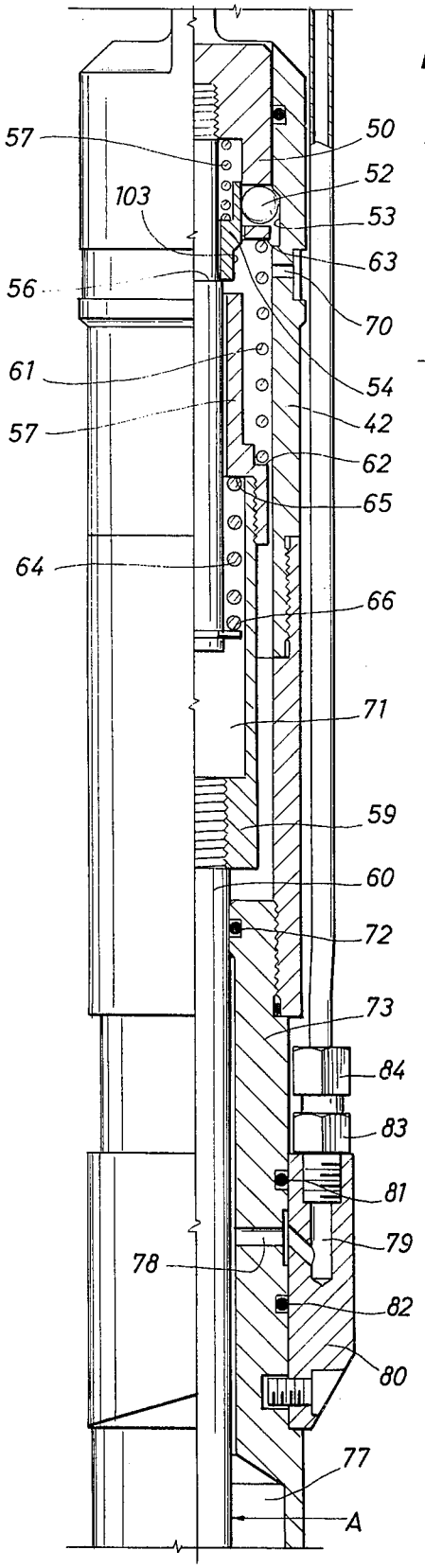
Figure 2C:
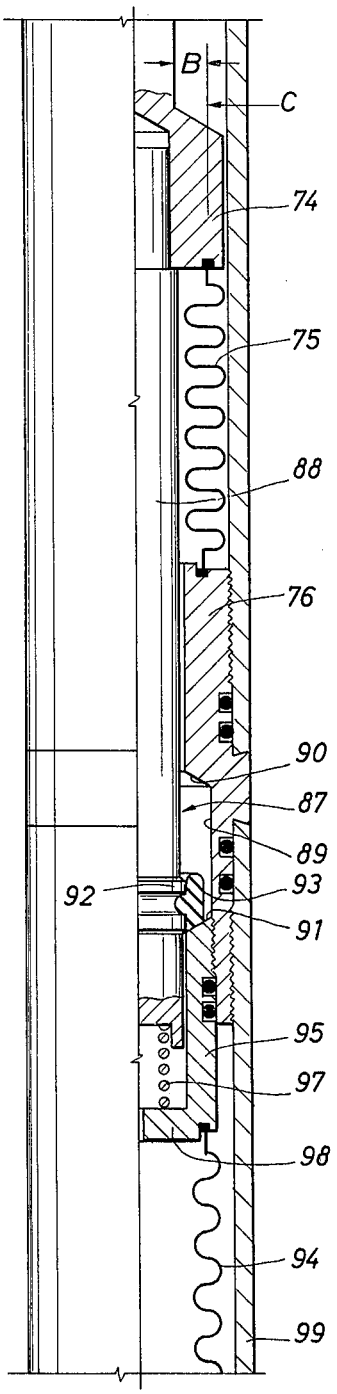
Figure 2D:
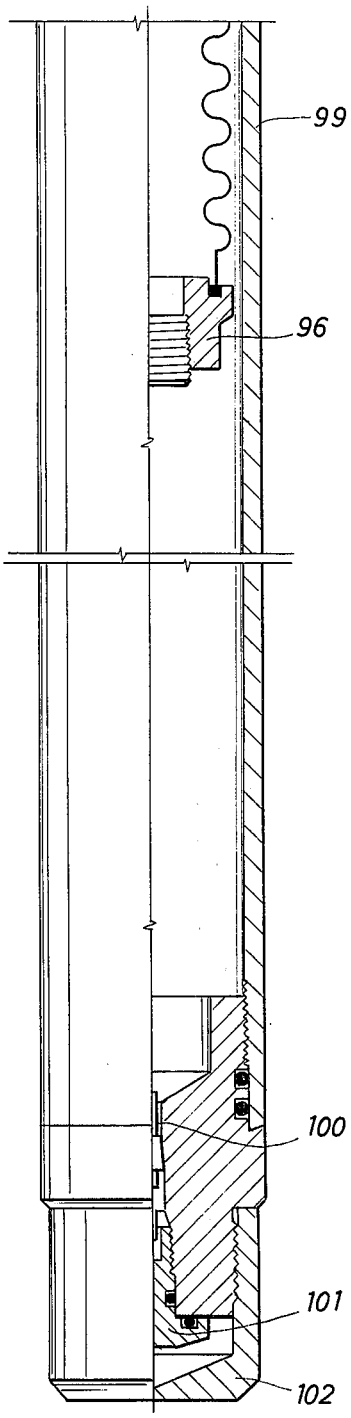

FIG. 1
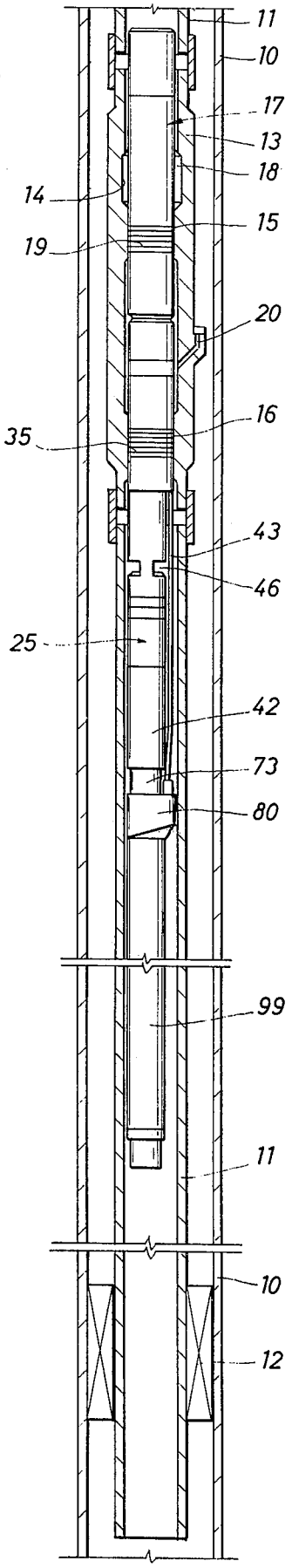
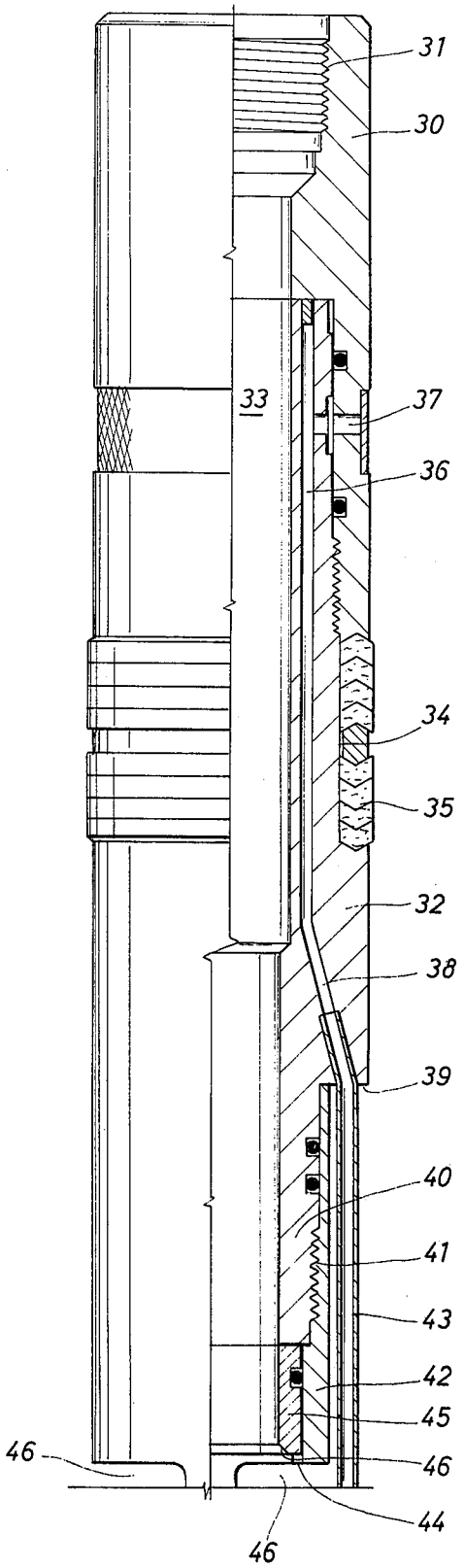
FIG. 2A

SUBSURFACE SAFETY VALVE APPARATUS

This invention relates generally to subsurface safety valves used in producing oil wells, and particularly to a new and improved normally closed safety valve that is held open by a remotely applied control pressure, and which will close automatically in response to abnormal well conditions.

Remote controlled subsurface safetly valves typically have taken the form of including a spring loaded piston with tubing pressure acting on one side and the pressure of a hydraulic control fluid actng on the other side. The spring must be strong enough to predominate over the hydrostatic head of the control fluid by an amount sufficient to cause the valve to close upon loss of applied control fluid pressure. The requirements of a sufficiently strong spring, and the dimensional restraints imposed by use of the device in a small diameter tubing string, have limited the depth at which this type of safety valve can be installed in the production tubing to a few hundred feet of the well surface. On the other hand, it is highly desirable ot be able to install the safety valve as far down in the production tubing as possible to provide full string protection in the event of surface damage to, or malfunction of, the wellhead production facilities, flow lines and the like.

It is accordingly one object of the present invention to provide a new and improved remote controlled subsurface safety valve that does not rely on a coil spring to provide closing force and can be arranged for setting at great depths below the earth's surface.

Another problem that has resulted from use of a coil closing spring in prior art devices of the type described is the requirement of a necessarily large "spread" between opening and closing pressures where such valves have been set fairly deep in a well. This is due to the fact that, as noted above, a very stiff spring must be used to be able to overcome the hydrostatic pressure of the control fluid with increased setting depth, and the increased spring stiffness necessitates a corresponding increase in the amount of control fluid pressure that must be applied to hold the valve open. On the other hand, a relatively narrow spread is desirable from the standpoint of valve sensitivity and to ensure leakproof integrity of the system.

It is another object of the present invention to provide a new and improved subsurface safety valve that can be installed at great depths below the earth's surface while still retaining a low spread between opening and closing control fluid pressures.

These and other objects are attained in accordance with the concepts of the present invention through the provision of a safety valve apparatus comprising a valve body having a flow passage and a valve element for opening and closing the flow passages. The valve element is controlled by a system including a dome and bellows that can be pressureized to a selected pressure which tends to close the valve element, and hydraulic means responsive to the pressure of a control fluid and to tubing pressure for holding the valve element open against the pressure in the dome. The pressure of the control fluid is fed to the hydraulic means by passages that communicate through a landing nipple, from which the valve apparatus is anchored, to a region outside the tubing whereby control pressure may be applied either to fluids standing in the casing-to-tubing annulus or to a control line extending from the landing nipple to the top of the well. In either case the dome pressure is set at a value in excess of the hydrostatic head of the control fluid, and the valve element is held open byapplying at the surface a control pressure which acts together with tubing pressure on the hydraulic means to overbalance the dome pressure. In the event of a loss of applied control pressure due to surface monitor of an impending dangerous condition, the valve element is closed by a predominance of dome pressure to shut-in the well. The various pressures may also be set so that the valve will close in response to a drop in tubing pressure upstream of the valve body inlet ports.

Since the safety valve apparatus of the present invention does not use a coil spring to cause valve closure, but rather employs a dome pressure and bellows control, the valve can be installed at substantially any depth to provide full tubing string protection. Moreover, the elimination of a need for a stiff coil spring at greater installation depths, as in the prior art, permits retention of a relatively small spread between opening and closing pressures for the valve.

The present invention has other objects, features and advantages which will become clearly apparent in connection with the following detailed description of a preferred embodiment, taken in conjunction with the appended drawings in which:

FIG. 1 is a somewhat schematic view of a well having the safety valve of the present invention installed therein; and FIGS. 2A–2D are longitudinal sectional view, with portions in side elevation, of the safety valve apparatus of the present invention.

Referring initially to FIG. 1, a well installation for producing oil includes casing 10 and a string of production tubing 11 that extend from the surface down to a producing well interval. A typical well packer 12 seals off the annulus between the casing and the tubing and confines the flow of oil to the tubing 11. A landing nipple 13 is installed in the tubing string and has an internal latching recess 14 and spaced-apart upper and lower seal bores 15 and 16. A retrievable hanger mandrel assembly 17, for example of the type shown at page 4000 of the 1974–75 edition of the Composite Catalog of Oilfield Equipment and Services, is shown located within the landing nipple 13, and is provided with laterally shiftable dogs 18 that are engaged in the mandrel recess 14 in order to anchor the assembly in the nipple. Seal packing 19 on the outside of the mandrel 17 engages the upper seal bore 15 to prevent fluid leakage. A laterally directed port 20 extends through the wall of the landing nipple 13 to provide a path for the communication of the pressure from the exterior to the interior of the nipple in the region between the upper and lower seal bores 15 and 16. A safety valve assembly 25, constructed in accordance with the principles of the present invention, is threadedly connected to the lower end of the hanger mandrel 17 and is suspended thereby within the tubing 11 below the landing nipple 13.

The safety valve assembly 25, shown in detail in FIGS. 2A–2D, includes an upper sub 30 having internal threads 31 that are connected to external threads on the lower end of the hanger mandrel 17. The sub 30 is threaded onto a tubular valve body member 32 having a throughbore 33 for the passage of fluid, and an external annular recess 34 that carries seal packing 35 which engages the lower seal bore 16 of the landing nipple. A pressure path 36 extends axially within the wall of the body member 32 from an upper port 37 opening to the exterior the sub 30 above the seal packing 35, and a lower port 38 which opens through a downwardly facing shoulder 39 located below the packing 35. The lower porion 40 of the valve body member 32 is formed eccentrically of the upper portion thereof, and is threaded at 41 to a ported sleeve 42 so as to provide external lateral clearance space for the reception of an elongated, small diameter pressure tube 43 having its upper end fitted in a lead-proof manner into the shoulder 39 in communicaton with the port 38. The sleeve 42 has an inwardly directed shoulder 44 that retains a valve seat ring 45 that is located immediately above flow inlet ports 46 in the valve body.

The valve assembly 25 further includes an annular valve disc 50 that is movable vertically between a lower open position below the valve body inlet ports 46 and an upper closed position where the disc engages the valve seat ring 45 that surrounds the flow passage 33 leading upwardly through the body 32. In the closed position, an upper surface of the valve disc 50 engages a downwardly and outwardly inclined surface 51 on the seat 45 in such a manner that the metal-to-metal engagement of the disc 40 and the seat 41 provide a leak-proof shut-off against upward flow. Normally, however, the valve disc 50 is locked in the lower open position by a plurality of ball detents 52 that are held engaged with respect to an internal annular recess 53 on the body sleeve 42, by a locking ring 54 that is positioned behind the ball detents. The locking ring 54 is slidable relatively along a valve stem 55 above a shoulder 56 thereon, and is urged downwardly against the shoulder by a coil spring 57. The locking ring 54 is arranged to be shifted upward to released position in response to a predetermined amount of upward movement of a tubular unlocking sleeve 57 which extends downwardly over the stem 55 and has its closed lower end 59 connected to the upper end of an elongated piston rod 60. A valve closing spring 61 reacts between an outwardly directed shoulder 62 on the sleeve 57 and a downwardly facing surface 63 on the valve disc 50 and is arranged to be compressed in response to upward movement of the unlocking sleeve 57. In addition, a recocking spring 64 is arranged to react between a downwardly facing surface 65 on the sleeve 57 and an outwardly directed shoulder 66 on the stem 55.

A plurality of radially extending pressure sensing ports 70 are provided through the wall of the valve body sleeve 42 below the level of the valve disc 50 to communicate the flowing pressure of fluids upstream of the inlet ports 46 to the interior space 71 above the upper end of the piston rod 60 where such pressure can act downwardly on the rod over an area encircled by an O-ring 72 on the upper end of the cylinder sleeve 73 fixed to the lower end of the valve body sleeve 42. The enlarged lower end 74 of the piston rod 60 is sealingly connected to the upper end of a main bellows 75 whose lower end is sealingly connected to a collar 76 threaded to the lower end of the cylinder sleeve 73. The annular space 77 between the external surfaces of the piston rod 60 and the bellows 75, on the one hand, and the internal surfaces of the cylinder sleeve 73, on the other, is placed in communication with the lower end of the pressure tube 43 by a lateral port 78 that leads to a channel 79 formed in a connector collar 80 which surrounds the cylinder sleeve and is sealed with respect thereto by O-rings 81 and 82. Pressure fittings 83 and 84 seal the lower end of the tube 43 with respect to the collar 80.

Located below the main bellows 75 is a bellows protection unit 87 of the general type described in U.S. Pat. No. 3,183,921, Garrett, assigned to the assignee of this invention. The unit 87 includes an elongated plunger 88 having its upper end slidably fitted within the lower porton 74 of the piston rod 60 and its lower end section slidably disposed within a chamber 89. The chamber 89 is defined in part by spaced apart, oppositely facing valve seats 90 and 91 with the upper seat being engaged by an annular valve head 92 and seal 93 on the plunger 88 in the uppermost position of the plunge, and the lower seat being engaged by the valve head and seal in the lowermost position on the plunger. A fluid retaining bellows 94 is sealably connected to an annular member 95 which is threadedly fixed to the collar 76 and has its lower end connected to a closure cap 96. The main bellows 75, the chamber 89 and the retaining bellows 94 provide an enclosed and sealed chamber space which is completely filled with an incompressible liquid. The plunger 88 may be biased upwardly by a coil spring 87 positioned between the lower end of the plunger and a ported transverse section 98 of the member 95.

The retaining bellows 94 is located within an elongated tubular housing 99 which provides a dome that is charged to a preselected pressure value with a compressible fluid medium such as nitrogen gas through a charge port 100 that then is closed by a plug 101. A protective cap 102 may be threaded onto the closed lower end of the housing 99.

The bellows protection unit 87 enables the piston rod 60 to be subjected to extreme pressures, and the dome to be pressurized to a high set pressure, while still maintaining a low differential pressure across the main bellows 75, in the following manner. When pressures acting through the sensing ports 70 on the upper end of the rod 60, and within the annular space 77 on the enlarged section 74 of the rod, predominate over dome pressure, the bellows 75 will contract causing the plunger 88 to move downwardly until the valve head 92 and seal 93 engage the lower valve seat 91. At this point, a portion of the incompressible liquid contained in the unit becomes trapped inside the bellows 75 so that a further increase in pressure will be transmitted only to the trapped liquid. On the other hand, when pressures acting on the rod 60 decrease below dome pressure, the main bellows 75 will elongate and allow the spring 97 to push the plunger 88 upwardly until the valve head 92 and seal 93 engage the upper seat 90. A value of pressure equal to the dome pressure at the instant the valve head seats then is trapped inside the main bellows 75 and any further elongation of the bellows will relieve this hydraulic pressure, this protecting the bellows against high differential pressures.

As pressures acting downwardly on the rod 60 fall below the preset dome pressure, as mentioned above, the bellows 75 extends and causes the unlocking sleeve 57 to shift upwardly, causing corresponding upward movement of the ball detent locking sleeve 54 and compression of the closing spring 61. At a point where a reduced diameter lower poriton 103 of the sleeve 54 is positioned adjacent the ball detents 52, the detents are enabled to shift laterally inwardly and out of engagement with the internal groove 53 in the valve body sleeve 42. The closing spring 61 then snaps the valve disc 50 quickly upwardly against the valve seat ring 45 to close off the flow passage 33.

The valve disc 50 may be reoopened by an increase in pressure which causes the main bellows 75 to contract. As the unlocking sleeve 57 shifts downwardly, the recocking spring 64 is compressed. When pressures are equalized across the valve disc 50, the spring 64 will drive the stem 55 and the attached disc downwardly until the ball detents 52 arrive opposite the recess 53, whereupon the locking sleeve spring 57 pushes it downwardly to reposition and lock the detents in the recess.

Further to the operation of the present invention, the safety valve is prepared at the surface for installation at a predetermined depth in the well by pressurizing the interior of the dome 99 with a compressible fluid such as nitrogen gas to a selected pressure value as will be discussed further below. The valve assembly 25 then in connected to the lower end of the hanger mandrel 17 and run into the tubing string 11 where it is installed in the landing nipple 13 by appropriate setting procedure as will be apparent to those skilled in the art. When installed, the pressures of fluids in the well annulus between the tubing 11 and the casing 10 are transmitted via the passage 20 to the interior of the landing nipple between the upper and lower seals 19 and 35 where such pressure is communicated by passage 36, the tube 43 and the port 78 to the space 77 within the cylinder sleeve 73 wherein it tends to cause contraction of the bellows 75 by acting over a transverse cross-section area denoted by the letter B in FIG. 2C of the drawings. If desired, a small diameter control line that is strapped to the tubing 11 may extend from the landing nipple 13 to the surface and contain a hydraulic control fluid. In any event, the ambient pressure of the well fluids upstream of the valve inlet ports 46 is acting downwardly on the cross-section area of the upper portion of the rod 60 denoted by the letter A in the drawings. Acting in opposition to such pressure forces is the pressure of the gas in the dome 99 which is tending to cause extension of the bellows 75 by acting on a transverse cross-sectional area denoted by the letter C, which is the area of the bellows. Of course so long as the total force due to ambient pressure and annulus pressure acting on the area A and B, respectively, exceed the force due to dome pressure acting upwardly on the area C, the main bellows 75 will remain contracted and the valve element 50 in the lower open position. On the other hand whenever the force due to dome pressure predominates, the rod 60 can move upwardly to enable the valve element 50 to close.

As an example, and not by way of limitation, of the pressures and other parameters that may be employed in a given situation the landing nipple 13 could be at a depth of 5000 ft. where the hydrostatic head of the fluids in the tubing-casing annulus ia about 2500 psi. The normal flowing pressure of fluids in the tubing 11 at the level of the valve if 1500 psi. The cross-sectional area A of the piston rod 60 at the o-ring 72 is about 25% of the area B of the bellows 75, which is, of course, a variable dependent upon design of the valve. The dome 99 is precharged to a pressure of 3000 psi which acts on the area C and a control pressure of 1000 psi is applied at the surface to the annulus. Thus the valve will remain open unless (1) applied control pressure drops below 875 psi (125 psi spread) (2) flowing pressure drops below 500 psi, or (3) a combined decrease in ambient and control pressure is such that the dome pressure predominates. In other words, the valve will close when pressure conditions are such that, in this example, 25% of tubing pressure plus the pressure in the chamber 77 is less than the set reference presure in the dome 99. It is again emphasized that the ratio between the area A of the rod 60 and the area C of the bellows 75 is a design variable whereby the valve control can be made more or less sensitive to tubing pressure, as desired.

When pressure changes occur, the main bellows 75 will extend, carrying the rod 60 and the unlocking sleeve 57 upwardly to compress the valve closing spring 61 and shift the locking sleeve 54 upwardly to a position where the ball detents 52 are released. Then the closing spring 61 snaps the valve disc 50 upwardly against the seat ring 45 to shut-off fluid flow in an upward direction. The disc 50 is held in such closed position by the upwardly actng pressure differential thereacross. With flow stopped, the pressure at the valve will increase to a pressure equal to static bottom hole pressure, and a control pressure may be reapplied to the main bellows 75 to foreshorten and pull the unlocking sleeve 57 downwardly. Such movement compresses the recocking spring 64 and arms the valve to be reopened as soon as pressures across the valve disc 50 are equalized, which may be accomplished as soon as the surface damage has been repaired by pressurizing the tubing 11.

It now will be recognized that since the dome can be precharged at the surface to a set presure that is related to the hydrostatic head of the control fluid pressure at the particular depth of installation, a narrow spread can be maintained between the opening and closing pressures of the valve. The use of a dome and bellows control rather than a coil spring provides a valve that is not limited in setting depth. The hydraulic system for maintaining the valve open provides pressure responsive areas which readily can be varied in design to provide degrees of sensitivity to tubing pressure in the operation of the valve, providing a more versatile valve system than has heretofore been known in the art.

Since various changes or modifications may be made in the disclosed embodiment without departing from the inventive concepts disclosed herein, it is the aim of the appended claims to cover all such changes or modifications falling within the true spirit and scope of the present invention.

We claim:

1. Valve apparatus adapted for use in a production conduit of a well, comprising: a valve body having a flow passage, valve means movable between open and closed positions with respect to said flow passage; control means including a dome charged with a selected amount of pressure that tends to cause said valve means to move to said closed position; and hydraulic means responsive to the pressure of a control fluid and to the pressure of fluids flowing in said conduit for preventing closing of said valve means.

2. The valve apparatus of claim 1 further including first passage means for feeding the pressure of a control fluid externally of said conduit to said hydraulic means.

3. The valve apparatus of claim 2 further including second passage means for feeding the pressure of production fluids flowing internally of said conduit means to said hydraulic means.

4. The valve apparatus of claim 1 wherein said hydraulic means includes piston rod means sealingly slidable within cylinder means on said valve body, said piston rod means having downwardly facing transverse surfaces subject to the pressure of said dome, and first and second upwardly facing transverse surface subject to the respective pressures of said production and control fluids.

5. The valve apparatus of claim 4 wherein said first surface is smaller than said second surface.

6. The valve apparatus of claim 4 further including extensible and contractible bellows means for connecting said piston rod means to said pressure charged dome.

7. The valve apparatus of claim 6 further including means for protecting said bellows means from the imposition thereon of an excessive pressure differential.

8. Valve apparatus adapted for use in a well production conduit having a landing nipple connected therein, said nipple having a side port to communicate its interior with the pressure of a control fluid externally of said conduit, comprising: a valve body sealably anchored to said landing nipple, said valve body having a production fluid flow passage: valve means movable between positions opening and closing said flow passage; and valve actuator and control means for controlling the opening and closing of said valve means, including a dome containing a precharge pressure tending to cause closure of said valve means, hydraulic means responsive to the pressure of a control fluid for retaining said valve means in open position, and means for feeding pressure from said port means in said landing nipple to said hydraulic means to enable remote control of the opening and closing of said valve means by variation of the pressure of said control fluid.

9. The valve apparatus of claim 8 wherein said dome is precharged to a pressure in excess of the hydrostatic head of said control fluid at the level of said landing nipple.

10. The valve apparatus of claim 9 wherein said hydraulic means includes a longitudinally movable piston means sealingly slidable within cylinder means on said valve body, one side of said piston means being subject to the pressure of said control fluid via feeding means and the other side of said piston means being subject to the pressure of said dome.

11. The valve apparatus of claim 10 wherein said piston means also has a transverse area separate from said one side thereof subject to the ambient pressure of well fluids flowing past said valve body upstream of said valve means, whereby said piston means is sensitive to both conduit pressure and the pressure of said control fluid.

12. Thhe valve apparatus of claim 11 wherein said transverse area has a lesser size than the size of said one side of said piston means.

13. The valve apparatus of claim 10 wherein said valve body carries seal means engageable with said landing nipple below said side port, said feeding means including a pressure channel extending within said valve body from above to below said seal means, and tube means extending externally of said valve body from said channel means to said hydraulic means.

14. Valve apparatus adapted for use in a well production conduit having a landing nipple connected therein, said nipple providing communication of its interior with the well annulus exterior of said conduit, comprising: a hanger assembly sealably anchored in said landing nipple and carrying seal means engaging said nipple above the point of said communication with said annulus; a safety valve assembly suspended from said hanger assembly and carry seal mens engaging said nipple below said point of communication; said valve assembly including an elongated tubular valve body having a production fluid flow passage; valve means movable upwardly within said body from an open position to a position closing said fluid passage to upward flow; valve actuator means in said body for controlling the opening and closing of said valve means, said actuator means comprising piston rod means sealingly slidable within cylinder means on said body, said piston rod means being movable upwardly to enable closing of said valve means and downwardly to enable opening thereof; means including a precharged pressure dome for urging said piston rod means upwardly; and means for supplying a control fluid under pressure from a region within said landing nipple intermediate said seal means to said cylinder means to act downwardly on said piston rod means and hold said valve means open when the pressure of said control fluid exceeds the pressure in said dome.

15. The apparatus of claim 14 wherein said piston rod means is connected to said dome by extensible and contractible bellows means, and further including means for protecting said bellows means from the application of excessive pressure differentials.

16. The apparatus of claim 14 wherein said supplying means comprises a prssure channel extending within said valve body between locations above and below said seal means on said valve body, and piping means extending alongside the exterior of said valve body from said channel to said cylinder means.

17. The apparatus of claim 14 wherein said piston rod means includes a first upwardly facing transverse surface exposed to pressure in said cylinder means and a second upwardly facing transverse surface exposed to the pressure of fluids in said conduit upstream of said valve means, said second surface being of lesser area than said first surface.

* * * * *